US005411604A

United States Patent [19]

Inokuti et al.

[11] Patent Number: 5,411,604

[45] Date of Patent: May 2, 1995

[54] METHOD OF PRODUCING LOW IRON LOSS, LOW-NOISE GRAIN-ORIENTED SILICON STEEL SHEET, AND LOW-NOISE STACKED TRANSFORMER

[75] Inventors: Yukio Inokuti; Kazuhiro Suzuki, both of Chiba; Eiji Hina, Okayama, all of Japan

[73] Assignee: Kawasaki Steel Corporation, Japan

[21] Appl. No.: 8,531

[22] Filed: Jan. 26, 1993

[30] Foreign Application Priority Data

May 29, 1992 [JP] Japan ..... 4-139047

[51] Int. Cl.[6] ..... H01F 30/06

[52] U.S. Cl. ..... 148/112; 219/121.17; 219/121.35

[58] Field of Search ..... 148/111, 112, 113; 219/121.34, 121.25, 121.17, 121.14, 121.20, 121.12

[56] References Cited

U.S. PATENT DOCUMENTS

| | | | |
|---|---|---|---|
| 3,076,160 | 1/1963 | Daniels | 148/111 |
| 4,915,750 | 4/1990 | Salsgiver et al. | 148/112 |
| 4,919,733 | 4/1990 | Salsgiver et al. | 148/113 |
| 5,146,063 | 9/1992 | Inokuti | 219/121.35 |

*Primary Examiner*—George Wyszomierski
*Attorney, Agent, or Firm*—Austin R. Miller

[57] ABSTRACT

A grain oriented silicon steel sheet which exhibits reduced iron loss and which contributes excellent noise characteristics when used as a material of a stacked transformer. The sheet is produced by applying electron beam irradiation a finish-annealed grain oriented silicon steel sheet, along scan paths which cross the rolling direction at a scanning speed v(cm/s) and a spacing L(cm) in the rolling direction, with an electron beam of a beam diameter d (cm) generated by a current $I_b$ (mA) and acceleration voltage $V_k$ (kV);

wherein the surface energy density $\alpha$ (J/cm$^2$) on the surface of said steel sheet as determined by the following formula (1) is about 0.16 J/cm$^2$ or more, and said surface energy density $\alpha$ (J/cm$^2$) and the surface energy density $\beta$ (J/cm$^2$) on the scan paths meet the approximate condition of the following formula (3):

$$\alpha=(V_k \cdot I_b)/(L \cdot v) \quad (1)$$

$$\beta=(V_k \cdot I_b)/(d \cdot v) \quad (2)$$

$$0.6-0.06\beta \leqq \alpha \leqq 0.90-0.08\beta \quad (3)$$

Disclosed also is a stacked transformer produced from this grain oriented silicon steel sheet.

8 Claims, 4 Drawing Sheets

METHOD OF PRODUCING LOW IRON LOSS, LOW-NOISE GRAIN-ORIENTED SILICON STEEL SHEET, AND LOW-NOISE STACKED TRANSFORMER

BACKGROUND OF THE INVENTION

1. Field of the Invention

This invention relates to electron beam irradiation for producing a reduced iron loss grain oriented silicon steel sheet which generates low noise when used in a stacked transformer. More particularly, this invention relates to a method of producing a grain oriented silicon steel sheet for use in a stacked transformer, where it achieves both reduced iron loss and reduced noise. This invention also relates to a stacked transformer comprising such grain oriented silicon steel sheets, which achieves significantly reduced noise generation in operation.

Grain oriented silicon steel sheets are used mainly as the core materials of electrical components such as transformers or the like. In general, grain oriented silicon steel sheets are required to have such magnetic characteristics that the magnetic flux density (represented by $B_8$) is high and that the iron loss (represented by $W_{17/50}$) is low. It is also required that the surfaces of the steel sheet have insulating films with excellent surfaces.

The energy crisis that the world now faces requires reduction of losses of electrical power. This has given rise to a strong demand for grain oriented silicon steel sheets having reduced iron loss.

2. Description of the Related Art

Grain oriented silicon steel sheets have undergone various treatments for improving magnetic characteristics. For instance, treatment has been conducted to attain a high degree of concentration of the secondary recrystallization grains in the Goss orientation. It has also been attempted to form, on a forsterite film formed on the surface of the steel sheet, an insulating film having a small thermal expansion coefficient so as to impart a tensile force to the steel sheet. Thus, grain oriented silicon steel sheets have been produced through complicated and diversified processes which require very strict controls.

Among these treatments, one major technique for reducing iron loss of grain oriented steel sheet has been the improvement of the aggregation structure of Goss orientation secondary recrystallization grains.

Hitherto, as a method for controlling the secondary recrystallization grains, preferential growth of Goss orientation secondary recrystallization grains has been obtained by using primary recrystallization grain growth inhibiting agents such as AlN, MnS and MnSe, known as "inhibitors".

In recent years various techniques other than metallurgical measures have been developed for controlling secondary recrystallization grains for reducing iron loss. For instance, techniques for reducing iron loss by irradiation with laser beams have been proposed in IRON AND STEELS, by Tadashi Ichiyama 69(1983), P895, Japanese Patent Publication No. 57-2252, Japanese Patent Publication No. 57-53419, Japanese Patent Publication No. 58-26405 and Japanese Patent Publication No. 58-26406. Methods also have been proposed which employ plasma irradiation as disclosed, for example, in Japanese Patent Laid-Open No. 62-96617, Japanese Patent Laid-Open 62-151511, Japanese Patent Laid-Open No. 62-151516 and Japanese Patent Laid-Open No. 62-151517. In these methods local treatment is introduced into the steel sheet by irradiation of the steel sheet surface by laser beam or plasma, so as to refine the magnetic domains, thereby reducing iron loss.

These methods relying upon irradiation with laser beam or plasma, however, inevitably raise the cost of reducing iron loss, because the energy efficiency is as low as 5 to 20%.

Under these circumstances we have proposed a method in which an electron beam generated by electric power of high voltage and low current is locally and intermittently applied along the widthwise direction which intersects the rolling direction of the sheet, so as to forcibly introduce a coating film into the matrix iron. Such a method is disclosed, for example, in Japanese Patent Laid-Open No. 63-186826, Japanese Patent Laid-Open No. 2-118022 and Japanese Patent Laid-Open No. 2-277780.

This method exhibits very high energy efficiency, as well as high scanning speed, thus offering remarkably improved production efficiency as compared to known methods for refining magnetic domains.

The methods disclosed in our above-mentioned Japanese Patent Laid-Open specifications are directed to production of grain oriented silicon steel sheet for use as a material for a wound core transformer. In the production of a core of this kind, the wound core formed from a grain oriented steel sheet is subjected to stress-relieving annealing. Therefore, no substantial noise tends to be generated in the wound core transformer during operation of the transformer.

In contrast, a stacked transformer of that kind generates a high level of noise, requiring strong measures to be taken for reducing the noise.

In particular, the grain oriented steel sheets produced by the method proposed in the aforementioned Japanese Patent Laid-Open specification cannot be practically used in stacked transformers, due to high levels of noise.

On the other hand, U.S. Pat. No. 4,919,733 discloses a method for refining magnetic domains by irradiation with electron beams, wherein the surface energy density on the electron beam scan line is set to a level not lower than 60 J/in$^2$ (9.3 J/cm$^2$). More specifically, Example 1 of this Patent shows that an electron beam treatment reduced the core loss at 1.7 T by about 10% when the treatment was conducted under the following conditions:

Beam acceleration voltage: 150 kV
Beam current: 0.75 mA
Scanning speed: 100 in/sec (254 cm/sec)
Beam diameter: 5 mil (0.013 mm)
Irradiation line spacing: 6 mm.

Steel sheets which have undergone this electron beam treatment, however, exhibit inferior noise characteristics when employed in a stacked transformer, as compared with steel sheets which have not undergone such electron beam treatment. In particular, the noise characteristics are extremely poor during operation of the transformer after the electron beam treatment has been conducted under the conditions mentioned above, as compared with sheets which have not undergone such treatment.

U.S. Pat. No. 4,915,750 proposes a method of producing a grain oriented silicon steel sheet for use as a material of a wound core transformer, employing refining of magnetic domains by irradiation with an electron beam. This method is directed only to the production of a wound core transformer as distinguished from a stacked transformer to which the present invention pertains and which suffers from the noise problem.

SUMMARY OF THE INVENTION

Accordingly, an object of the present invention is to provide a method for stably producing a grain oriented steel sheet of high quality which exhibits not only reduced core loss but also significantly reduced noise when used in a stacked transformer.

It is also an object of the present invention to provide a stacked transformer having improved noise characteristics.

To these ends, according to one aspect of the present invention, we have created a method of producing a grain oriented silicon steel sheet which exhibits reduced iron loss and which, when used as a material of a stacked transformer, achieves sharply reduced noise characteristics.

The method of this invention is advantageously performed by preparing a finish-annealed grain oriented silicon steel sheet, irradiating the surface of the grain oriented silicon steel sheet along scan paths which cross the rolling direction of the steel sheet at a scanning speed v(cm/s) and a spacing L(cm) in the direction of rolling, such irradiation being performed with an electron beam of a beam diameter d (cm) generated by a current $I_b$ (mA) and an acceleration voltage $V_k$ (kV) and wherein the surface energy density $\alpha$ (J/cm$^2$) on the surface of said steel sheet is controlled as determined by the following formula (1) to about 0.16 J/cm$^2$ or more, and said surface energy density $\alpha$ (J/cm$^2$) and the surface energy density $\beta$ (J/cm$^2$) on the scan paths meet approximately the condition of the following formula (3):

$$\alpha=(V_k \cdot I_b)/(L \cdot v) \quad (1)$$

$$\beta=(V_k \cdot I_b)/(d \cdot v) \quad (2)$$

$$0.6-0.06\beta \leqq \alpha \leqq 0.90-0.08\beta \quad (3)$$

According to another aspect of this invention we have provided a low-noise stacked transformer produced in accordance with the method of the present invention.

DETAILED DESCRIPTION OF THE INVENTION

A detailed description will now be given of an experiment, with reference to FIG. 1 which shows an electron beam irradiation apparatus employed in the experiment. The experiment is intended to be illustrative but not to limit the scope of the invention, which is defined in the appended claims.

Figure 1:
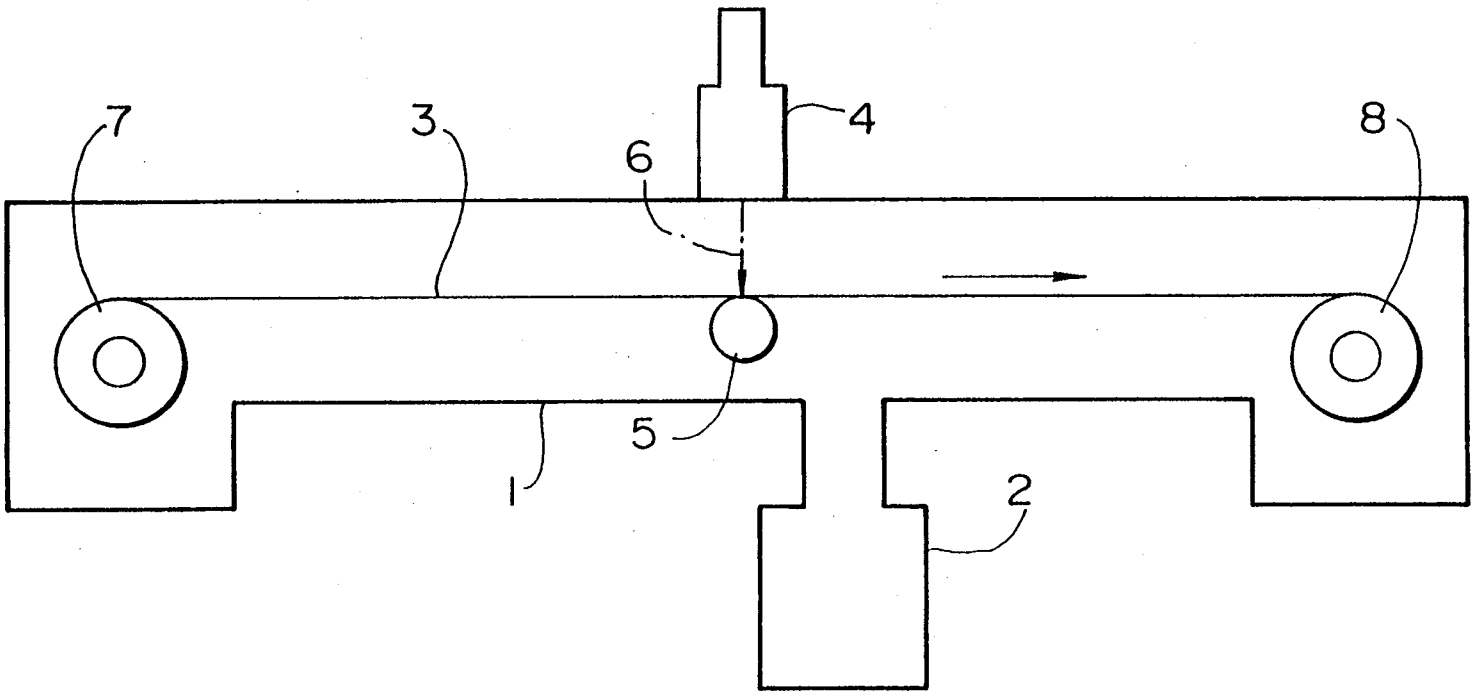
FIG. 1 is a diagram of an electron beam apparatus which may be employed in the method of this invention.

Referring to FIG. 1, the electron beam irradiation apparatus has a vacuum chamber 1 in which vacuum is maintained by operation of a vacuum pump 2. Numeral 3 designates a grain oriented silicon steel sheet. The apparatus also has an electron beam gun 4 and a graphite roller 5. Numeral 6 denotes an electron beam emitted from the electron beam gun 4. Numerals 7 and 8 respectively denote respectively a pay-off reel and a tension reel for the sheet 3 which runs in the direction indicated by the arrow. In this apparatus the grain oriented silicon steel sheet 3 paid off from the pay-off reel 7 passes through a vacuum chamber 1. The portion of the steel sheet 3 directly under the electron beam gun 4 is irradiated by the electron beam 6 which scans the steel sheet 3 linearly in a breadthwise direction substantially perpendicular to the direction of rolling. As a result of the irradiation minute linear thermal strain regions are introduced into the grain oriented silicon steel sheet 3, thus refining the magnetic domain structure, thereby reducing its core loss. The sheet 3 thus treated is then taken up by the tension reel 8.

The particular grain oriented silicon steel sheet employed in the foregoing experiment was obtained by the following process: A hot-rolled steel sheet was prepared which had a composition containing C: 0.065 wt %, Si: 3.38 wt %, Mn: 0.080 wt %, Al: 0.028 wt %, S: 0.030 wt % and N: 0.0068 wt % and the balance substantially Fe. The hot-rolled steel sheet was then uniformly annealed for 3 minutes at 1150° C., followed by quenching. The steel sheet was then warm-rolled at 300° C. until 0.23 mm thick. Subsequently decarburization annealing was conducted in a humid hydrogen atmosphere at 850° C., and an annealing separation agent mainly composed of MgO was applied to the surfaces of the steel sheet. Secondary recrystallization was then effected by raising the temperature from 850° C. to 1150° C. at a rate of 8° C./hour, followed by purifying annealing for 8 hours in a dry hydrogen atmosphere at 1200° C.

Subsequently, an insulating film was applied and baked and then flattening annealing was conducted, whereby the grain oriented silicon steel sheet, as the steel sheet to be employed in the experiment, was prepared. This grain oriented silicon steel sheet had the following magnetic characteristics.

Iron loss ($W_{17/50}$): 0.88 W/kg

Magnetic flux density: ($B_8$): 1.92 T

Samples were prepared by irradiating electron beams under the following test conditions which were combined in various manners so that 162 samples in total were prepared.

Beam acceleration voltage $V_k$: 130, 150, 180 kV

Beam current $I_b$: 0.6, 0.8, 1.0 mA

Beam diameter d: 0.20, 0.30 mm

Scanning speed v: 6, 8, 10 m/sec

Irradiation line spacing L: 3, 5, 7 mm

Levels of iron loss were measured on all 162 samples. Three-leg core type stacked transformers were fabricated by using about 100 kg of each of the 162 samples, and three-phase voltages were applied to the transformers to activate the transformers for measurements of levels of noise.

The noise (dB) of each transformer was measured by using a sound level meter specified by JIS (Japanese Industrial Standard) 1502 at positions directly above the three legs and at positions spaced 50 cm apart from the respective legs. Then, the mean values of the measured noise levels were calculated as dBi (i=1 to 162). The results of the measurement were evaluated by normalizing them to the values at 1.7 T/50 Hz. The noise measurement was conducted by using an A scale as specified by JIS 1502.

Three-leg core stacked transformers also were fabricated by using about 100 kg of each of the 162 samples which were not subjected to the electron beam irradiation, and noise levels were measured while applying three-phase voltages to these transformers. Noise levels were measured at three positions as described above, and the mean values of the measured noise levels were calculated as dB'i (i=1 to 162). The difference (dBi−dB'i) (i=1 to 162) for each sample was determined as the noise characteristic.

Figure 2:
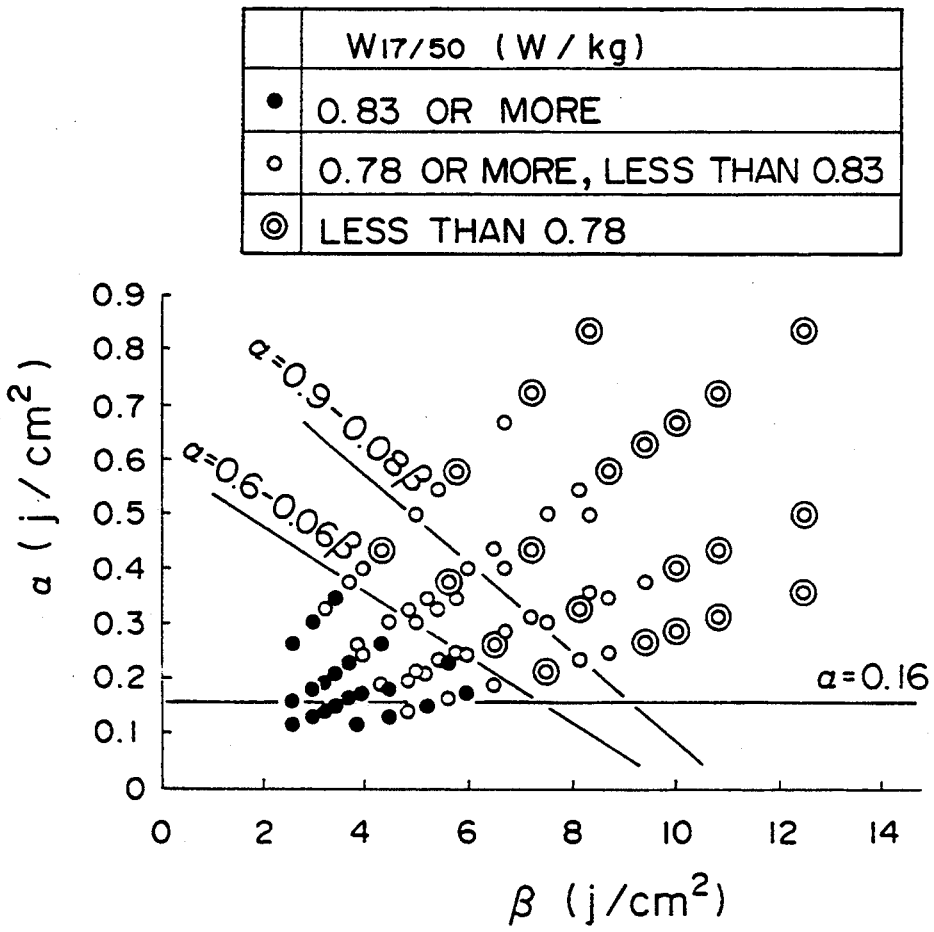
FIGS. 2 and 3 are graphs indicating test results obtained in the testing of the invention.

FIG. 2 shows the relationship between the iron loss, and the surface energy density $\alpha$ (J/cm$^2$) of the steel sheet surface as determined by the formula (1) and the surface energy density $\beta$ (J/cm$^2$) on the beam scanning line as determined by the formula (2).

Figure 3:
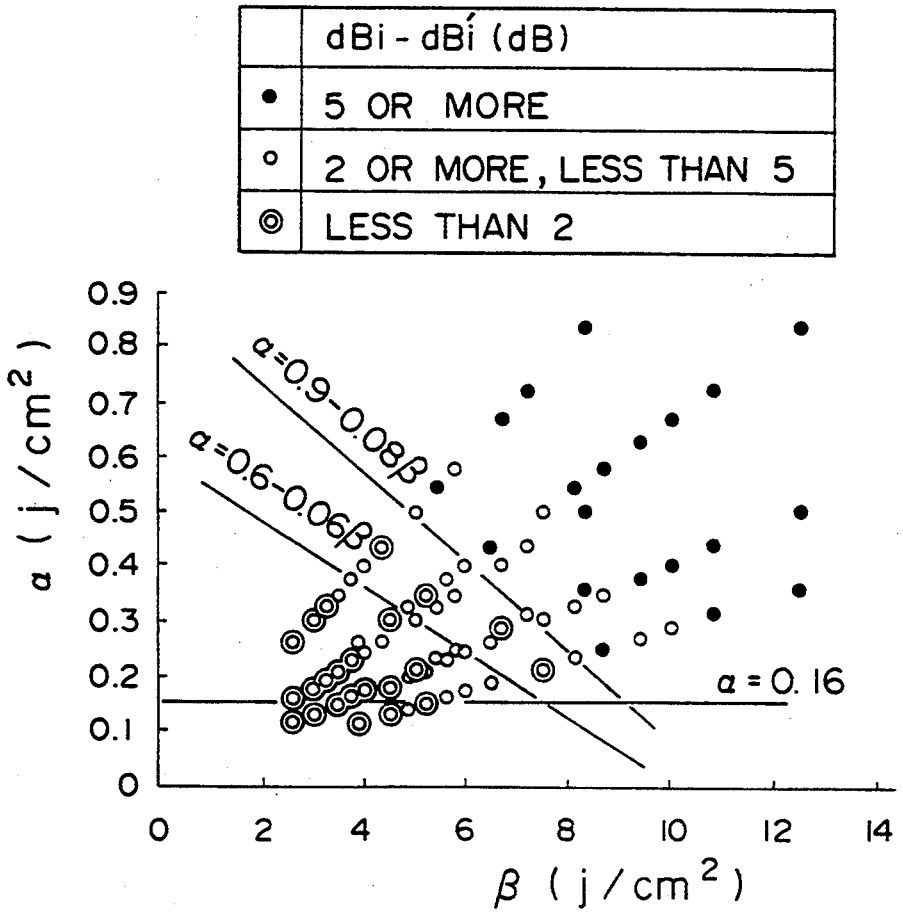

FIG. 3 shows the relationship between the noise characteristic and the surface energy density $\alpha$ (J/cm$^2$) of the steel sheet surface and the surface energy density $\beta$ (J/cm$^2$) on the beam scanning line.

The numbers of points plotted in FIGS. 2 and 3 are smaller than the number of experiments because some of the measured data overlapped.

$$\alpha=(V_k \cdot I_b)/(L \cdot v) \quad (1)$$

$$\beta=(V_k \cdot I_b)/(d \cdot v) \quad (2)$$

The following criteria were applied for evaluation. More specifically, the criterion for the evaluation of iron loss ($W_{17/50}$) was as shown in Table 1, while the criterion for the evaluation of the noise characteristic was as shown in Table 2.

TABLE 1

| $W_{17/50}$ | Evaluation | Marks in FIG. 2 | Remarks |
|---|---|---|---|
| 0.83 or more | Not good | • | Equivalent to conventional products |
| 0.78 or more but less than 0.83 | Good | ○ | Product standards graded up by ½ grade |
| Less than 0.78 | Excellent | ◎ | Product standards graded up by 1 grade |

TABLE 2

| Noise Difference dBi − dB'i (dB) | Evaluation | Marks in FIG. 3 | Remarks |
|---|---|---|---|
| 5 or more | Not good | • | No noise suppression effect |
| 2 or more but less than 5 | Good | ○ | Noise suppression effect produced |
| Less than 2 | Excellent | ◎ | Remarkable noise prevention effect |

The following will be understood from the foregoing experimental results.

In regard to iron loss, a superior iron loss characteristic is obtained when the surface energy density $\alpha$ is about 0.16 J/cm$^2$ or more while approximately meeting the condition of $\alpha \geqq 0.6-0.06\ \beta$.

It is also understood that an allowable noise characteristic is obtained when a condition of about $\alpha \geqq 0.90-0.08\ \beta$ is met.

From these results, it is understood that, in order to simultaneously achieve both reduction in iron loss and reduction in noise, it is important that the surface energy density $\alpha$ is about 0.16 J/cm$^2$ or more and approximately the condition of the following formula (3) is met.

$$0.6-0.06\ \beta \leqq \alpha \leqq 0.9-0.08\ \beta \quad (3)$$

If one or both of these requirements are not met, either the iron loss or the noise level requirements, or both, are not satisfied.

The method of the present invention offers a remarkable increase of irradiation speed not only over conventional magnetic domain refining methods employing laser beams or plasma but also over known magnetic domain refining methods using electron beams as disclosed in U.S. Pat. No. 4,919,733, so that the speed of treatment of the steel sheet is remarkably increased, thus contributing greatly to increase yield.

For instance, the speed of irradiation employed in the method of the present invention is about 4 times as high as that of the practical example shown in U.S. Pat. No. 4,919,733. In the practical example the surface energy density $\alpha$ on the steel sheet surface was 34 J/cm$^2$, while the surface energy density $\beta$ of the beam scan line was 0.74 J/cm$^2$. Thus, the surface energy density $\alpha$ was significantly outside the range of the present invention.

According to the invention superior iron loss characteristic, as well as an improved noise characteristic, is obtained when the surface energy density $\alpha$ is about 0.16 J/cm$^2$ or more while the approximate condition of the formula (3) mentioned above is met.

We consider that these effects are attributable to the following facts. When a steel sheet is irradiated with an electron beam, tension is generated between adjacent irradiation lines due to thermal strain which is caused by rapid thermal expansion occurring in the irradiated portions. Consequently, magnetic domains are refined to reduce abnormal eddy current loss. However, the thermal expansion causes thermal strain which degrades the noise characteristics. Thus, not only the surface energy density on the beam scan line but also the surface energy density of steel sheet including elements between adjacent irradiation lines is a significant factor which determines iron loss and noise characteristics of the transformer as the product.

Although substantially any practical grain oriented silicon steel sheet composition known heretofore may be employed in the present invention, the following composition and components are preferably employed:

C: about 0.01 to 0.10 wt %

This element is effective in uniformly refining the structure both in hot rolling and cold rolling, and also serves in development of Goss orientation. To obtain appreciable effects, the C content should preferably be about 0.01 wt % or more. However, the Goss orientation is disturbed when the C content exceeds about 0.10 wt %. The C content,therefore, should not exceed about 0.10 wt %. Si: about 2.0 to 4.5 wt %

This element effectively contributes to reduction of iron loss by enhancing the specific resistance of the steel sheet. Si content less than about 2.0 wt %, however, causes not only a reduction specific resistance but also random crystal orientation as a result of an $\alpha$-$\gamma$ transformation which takes place in the course of final hot annealing which is conducted for the purpose of secondary recrystallization/annealing, thus hampering reduction of iron loss. Conversely, cold rolling characteristics are impaired when the Si content exceeds about 4.5 wt %. The lower and upper limits of the Si content, therefore, are preferably set to about 2.0 wt % and 4.5 wt %. Mn: about 0.02 to 0.12 wt %

In order to avoid hot embrittlement the Mn content should be at least about 0.02 wt %. Excessive Mn content, however, degrades the magnetic characteristics. The upper limit of the Mn content, therefore, is set to about 0.12 wt %.

Inhibitors suitably employed can be sorted into three types: MnS type, MnSe type and AlN type. When an inhibitor of the MnS type or MnSe type is used, one or both inhibitors selected from the group consisting of S: about 0.005 to 0.06 wt % and Se: about 0.005 to 0.06 wt % is preferably used.

S and Se are elements which can effectively be used as an inhibitor which controls secondary recrystallization in grain oriented silicon steel sheet. For obtaining sufficient inhibition the inhibitor should be present in an amount of at least about 0.005 wt %. The effect of the inhibitor, however, is impaired when its content exceeds about 0.06 wt %. Therefore the lower and upper limits of the content of S or Se are set to about 0.005 wt % and 0.06 wt %, respectively.

When an inhibitor of AlN type is used, both Al: about 0.005 to 0.10 wt % and N: about 0.004 to 0.015 wt % should be present. The contents of Al and N should be determined to fall within the above-mentioned ranges of contents of inhibitor of MnS or MnSe type for the same reasons as stated above.

It is also possible to use other elements than S, Se and Al as the inhibitor, such as Cr, Mo, Cu, Sn, Ge, Sb, Te, Bi and P. Trace amounts of these elements may be used in combination as the inhibitor. More specifically, contents of Cr, Cu and Sn are preferably not less than about 0.01 wt % but not more than about 0.50 wt %, whereas, for Mo, Ge, Sb, Te and Bi, the contents are preferably not less than about 0.005 wt % but not more than about 0.1 wt %. The content of P is preferably not less than about 0.01 wt % but not more than about 0.2 wt %. Each of these inhibitors may be used alone or a plurality of such inhibitors may be used in combination.

The following Examples further illustrate the invention. They are not intended to limit the scope of the invention, which is defined in the appended claims.

Example 1

A hot-rolled steel sheet having a composition containing C: 0.063 wt %, Si: 3.40 wt %, Mn: 0.082 wt %, Ai: 0.024 wt %, S: 0.023 wt %, Cu: 0.06 wt % and Sn: 0.08 wt % was subjected to a uniformalizing annealing conducted for 3 minutes at 1150° C., followed by quenching. Warm rolling was conducted at 300° C., whereby a final cold-rolled sheet of 1000 mm wide and 0.23 mm thick was obtained.

Subsequently, after decarburization annealing in warm hydrogen at 850° C., an anneal separation agent, mainly composed of $Al_2O_3$ (80 wt %), MgO (15 wt %) and $ZrO_2$ (5 wt %), was applied to the surfaces of the steel sheet. Secondary recrystallization was conducted by heating the steel sheet from 850° C. up to 1150° C. at a rate of 10° C./hr, followed by 8-hour purifying annealing at 1200° C. and subsequent flattening annealing for baked insulation coat layer, whereby a grain oriented silicon steel sheet was obtained as the steel sheet to be used in the experiment.

Using this steel sheet a plurality of coils, each being 10 tons in weight, were produced.

Figure 4:
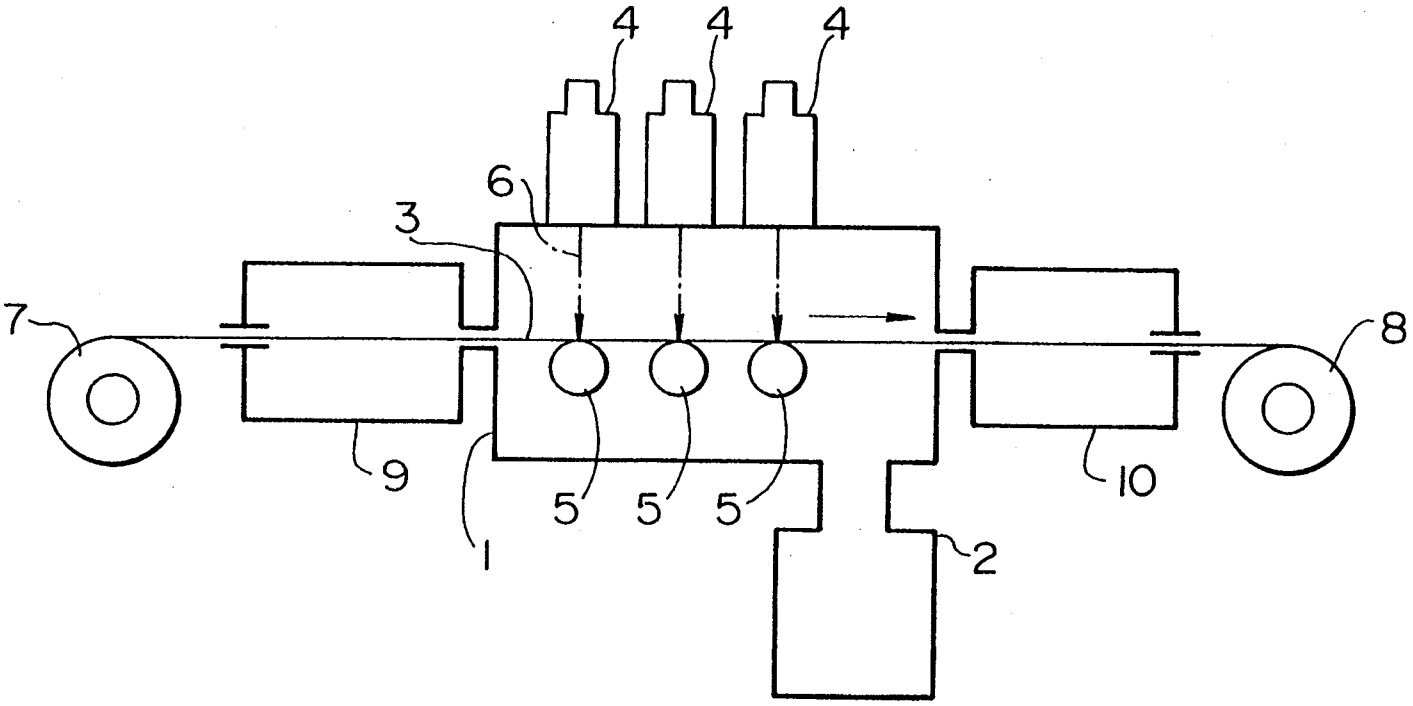
FIG. 4 is a diagram of another electron beam irradiating apparatus in accordance with the invention.

One of these coils was subjected to irradiation with an electron beam applied within the ranges of irradiation conditions of the invention in the direction perpendicular to the rolling direction by the electron beam irradiation apparatus shown in FIG. 4. At the same time, irradiation with an electron beam was also applied under conditions outside the ranges specified by the invention, thus effecting refining of the magnetic domains. The conditions of irradiation with the electron beam were as follows:

Beam acceleration voltage $V_k$: 150 kV
Beam current $I_b$: 0.9 mA
Scanning speed v: 1000 cm/sec
Irradiation line spacing L: 0.6 cm
Beam diameter d: 0.02 cm
$\alpha$: 0.23 J/cm$^2$
$\beta$: 6.8 J/cm$^2$ The irradiation apparatus shown in FIG. 4 was materially the same as that shown in FIG. 1. The apparatus employed three electron beam guns 4 arranged in the direction of the sheet breadth at a spacing in the direction of the run of the sheet. This apparatus was of the so-called air-to-air type in which steel sheet 3 was introduced from the exterior of the vacuum chamber 1 through pressure-differential chambers provided in the inlet side of the vacuum chamber 1 and the treated sheet was taken up by a tension reel 8 on the outside of the vacuum chamber 1 through pressure-differential chamber 10 provided on the outlet side of the vacuum chamber 1.

Samples were picked up from several portions on the leading and trailing ends of the coil of the steel sheet produced in accordance with the present invention, and the iron loss ($W_{17/50}$) and the magnetic flux density ($B_8$) were determined for each sample. Mean values of the iron loss and the iron loss and magnetic flux densities at the leading and trailing ends are shown in Table 3.

For the purpose of comparison, mean values of the iron loss ($W_{17/50}$) and magnetic flux density ($B_8$) were measured on the leading and trailing ends of coils produced from the same steel sheets as above but not subjected to irradiation with an electron beam. The results are shown in Table 4.

TABLE 3

Magnetic characteristics of steel sheets Produced by the Method of the Invention (Compared to Table 4)

| Sampling Position | Iron Loss $W_{17/50}$ (W/kg) | Iron Loss $\Delta W_{17/50}$ (W/kg)* | Magnetic Flux Density $B_8$ (T) | Magnetic Flux Density Difference $\Delta B_8$ (T)* |
|---|---|---|---|---|
| Leading End (Mean Value) | 0.785 | 0.114 | 1.923 | −0.002 |
| Trailing End (Mean Value) | 0.775 | 0.115 | 1.924 | −0.002 |

*Difference between values obtained with irradiated steel sheet and steel sheet not irradiated.

TABLE 4

Magnetic characteristics of steel sheets Not Irradiated with Electron Beam

| Sampling Position | Iron Loss $W_{17/50}$ (W/kg) | Magnetic Flux Density $B_8$ (T) |
|---|---|---|
| Leading End (Mean Value) | 0.899 | 1.925 |
| Trailing End (Mean Value) | 0.890 | 1.926 |

Using 5.1 tons of the steel sheet produced in accordance with the present invention, a stacked transformer having three-leg type core was produced and a three-phase voltage was applied to the transformer for measurement of noise generated during the operation of the transformer. The capacity of the transformer was 9000 KVA, while the transformation ratio was 66/6.6 KV.

The measurement of the noise (dB) of the transformer was conducted at positions directly above the these legs and of the core 50 cm spaced apart from the respective legs, by using a sound level meter specified by JIS 1502, and the mean value of the noise levels measured at these three positions was calculated. The measurement of the noise level was conducted by using an A scale as specified in JIS 1502. The results of measurement of noise are shown in Table 5.

By way of comparison, a stacked transformer similar to that shown above was fabricated using a coil made from the same steel sheet which was not subjected to electron beam irradiation. The results of measurement of the noise are shown in Table 6.

TABLE 5

Characteristics of Stacked Transformer of Invention (Compared to Table 6)

| Iron Loss $W_{17/50}$ (W/kg) | Iron Loss Difference From Transformer Made of Non-irradiated Steel Sheet ΔIron Loss, $W_{17/50}$ | Noise (dB) | Noise Difference From Transformer Made of Non-irradiated Steel Sheet (ΔdB) |
|---|---|---|---|
| 0.933 | 0.15 | 52 | 1 |

TABLE 6

Characteristic of Stacked Transformer Made from Steel Sheet Not Irradiated With Electron Beam

| Iron Loss $W_{17/50}$ (W/kg) | Noise (dB) |
|---|---|
| 1.083 | 51 |

From Tables 3 and 5, it will be understood that both iron loss and noise characteristic are remarkably improved according to the present invention which employs electron beam irradiation under the specified conditions.

According to the aforesaid criteria of evaluation, the iron loss of the steel sheet produced in accordance with the method of the present invention is "Good". The noise characteristic of the stacked transformer of the present invention was "Excellent".

Example 2

Refining of magnetic domains on a grain oriented silicon steel sheet the same as that in Example 1 was effected by electron beam irradiation in the same manner as Example 1 under the following conditions which fall within the range of the present invention. The iron loss of the steel sheet obtained through this treatment, as well as the noise of the stacked transformer, was measured by the same method as Example 1. The results of the measurement are shown in Tables 7 and 8.

From these Tables it will be understood that both the iron loss and the noise characteristics were significantly improved as a result of the electron beam irradiation executed under the conditions:

Beam acceleration voltage $V_k$: 200 kV
Beam current $I_b$: 0.4 mA
Scanning speed v: 500 cm/s
Irradiation line spacing L: 0.4 cm
Beam diameter d: 0.03 cm
$\alpha$: 0.4 J/cm$^2$
$\beta$: 5.3 J/cm$^2$

TABLE 7

Magnetic Characteristics of Steel Sheet of Invention (Compared to Table 4)

| Sampling Position | Iron Loss $W_{17/50}$ (W/kg) | Iron Loss $\Delta W_{17/50}$ (W/kg)* | Magnetic Flux Density $B_8$ (T) | Magnetic Flux Density Difference $\Delta B_8$ (T)* |
|---|---|---|---|---|
| Leading End (Mean Value) | 0.779 | 0.120 | 1.922 | −0.003 |
| Trailing End (Mean Value) | 0.789 | 0.121 | 1.923 | −0.002 |

*Difference between values obtained with irradiated steel sheet and steel sheet not irradiated.

TABLE 8

Characteristics of Stacked Transformer of Invention (Compared to Table 6)

| Iron Loss $W_{17/50}$ (W/kg) | Iron Loss Difference From Transformer Made of Non-irradiated Steel Sheet ΔIron Loss, $W_{17/50}$ | Noise (dB) | Noise Difference From Transformer Made of Non-irradiated Steel Sheet (ΔdB) |
|---|---|---|---|
| 0.929 | 0.154 | 53 | 2 |

Comparative Example 1

A magnetic domain refining treatment was conducted on a coil made of the same grain oriented silicon steel sheet same as that of Example 1, by applying an electron beam under the following conditions which did not satisfy the requirement of formula (3) of the present invention. The iron loss of the steel sheet thus obtained, as well as the noise of the stacked transformer, was measured by the same method as Example 1. The results of the measurement are shown in Tables 9 and 10.

From Tables 9 and 10 it will be understood that the noise characteristic of the transformer was inferior, although good iron loss characteristics were obtained, due to the fact that the conditions of irradiation with the electron beam did not meet the requirement of formula (3).

Beam acceleration voltage $V_k$: 100 kV
Beam current $I_b$: 1.0 mA
Scanning speed v: 500 cm/s
Irradiation line spacing L: 0.6 cm
Beam diameter d: 0.02 cm
$\alpha$: 0.33 J/cm$^2$
$\beta$: 10 J/cm$^2$

TABLE 9

Magnetic Characteristics of Steel Sheet of Comparative Example 1 (Compared to Table 4)

| Sampling Position | Iron Loss $W_{17/50}$ (W/kg) | Iron Loss $\Delta W_{17/50}$ (W/kg)* | Magnetic Flux Density $B_8$ (T) | Magnetic Flux Density Difference $\Delta B_8$ (T)* |
|---|---|---|---|---|
| Leading End (Mean Value) | 0.775 | 0.124 | 1.922 | −0.003 |
| Trailing End (Mean Value) | 0.774 | 0.136 | 1.921 | −0.005 |

*Difference between values obtained with irradiated steel sheet and steel sheet not irradiated.

TABLE 10

Characteristics of Stacked Transformer of Comparative Example 1 (Compared to Table 6)

| | Iron Loss Difference From Trans- | Noise Difference |
|---|---|---|

TABLE 10-continued

| Iron Loss $W_{17/50}$ (W/kg) | former Made of Non-irradiated Steel Sheet ΔIron Loss, $W_{17/50}$ | Noise (dB) | From Transformer Made of Non-irradiated Steel Sheet (ΔdB) |
|---|---|---|---|
| 0.930 | 0.153 | 60 | 9 |

Comparative Example 2

A magnetic domain refining treatment was conducted on a coil made of the same grain oriented silicon steel sheet same as that of Example 1, by applying an electron beam under the following conditions which did not satisfy the requirement of formula (3) in accordance with the present invention. The iron loss of the steel sheet thus obtained, as well as the noise of the stacked transformer, was measured by the same method as Example 1. The results of the measurement are shown in Tables 11 and 12.

From Tables 11 and 12 it will be understood that the iron loss characteristic was inferior, although a good noise characteristic of the transformer was obtained, due to the fact that the conditions of irradiation with the electron beam did not meet the requirements of formula (3):

Beam acceleration voltage $V_k$: 150 kV
Beam current $I_b$: 0.8 mA
Scanning speed v: 900 cm/s
Irradiation line spacing L: 0.7 cm
Beam diameter d: 0.03 cm
$\alpha$: 0.19 J/cm$^2$
$\beta$: 4.4 J/cm$^2$

TABLE 11

Magnetic Characteristics of Steel Sheet of Comparative Example 2 (Compared to Table 4)

| Sampling Position | Iron Loss $W_{17/50}$ (W/kg) | Iron Loss $\Delta W_{17/50}$ (W/kg)* | Magnetic Flux Density $B_8$ (T) | Magnetic Flux Density Difference $\Delta B_8$ (T)* |
|---|---|---|---|---|
| Leading End (Mean Value) | 0.862 | 0.037 | 1.925 | 0 |
| Trailing End (Mean Value) | 0.860 | 0.050 | 1.926 | 0 |

*Difference between values obtained with irradiated steel sheet and steel sheet not irradiated.

TABLE 12

Characteristics of Stacked Transformer of Comparative Example 2 (Compared to Table 6)

| Iron Loss $W_{17/50}$ (W/kg) | Iron Loss Difference From Transformer Made of Non-irradiated Steel Sheet ΔIron Loss, $W_{17/50}$ | Noise (dB) | Noise Difference From Transformer Made of Non-irradiated Steel Sheet (ΔdB) |
|---|---|---|---|
| 1.04 | 0.043 | 52 | 1 |

As will be understood from the foregoing description, according to the present invention, it is possible to obtain a low-iron-loss grain oriented silicon steel sheet for use as the material of a stacked core transformer, the steel sheet simultaneously exhibiting both superior iron characteristics and excellent noise characteristics in the stacked transformer, by virtue of the fact that irradiation with the electron beam is executed at specified levels of energy density of the beam scan line and of surface energy density. In addition, the present invention offers remarkable improvements of production efficiency.

What is claimed is:

1. A method of producing a grain oriented silicon steel sheet having reduced iron loss and which, when used as a material in a stacked transformer, makes it possible to obtain a noise difference (dBi−dB'i) less than 5 dB, said method comprising:

preparing a finish-annealed grain oriented silicon steel sheet;

irradiating the surface of said grain oriented silicon steel sheet with an electron beam directed along scan paths which cross the rolling direction of said steel sheet, said irradiation being applied to said sheet at a scanning speed v(cm/s) and a spacing L(cm) in the rolling direction, with an electron beam having a beam diameter d(cm) generated by a current $I_b$ (mA) and an acceleration voltage $V_k$ (kV);

wherein said beam is applied with a surface energy density $\alpha$ (J/cm$^2$) on the surface of said steel sheet as determined by the following formula (1), and is about 0.16 J/cm$^2$ or more, and wherein said surface energy density $\alpha$ (J/cm$^2$) and a surface energy density $\beta$ (J/cm$^2$) on the scan paths meet the approximate condition of the following formula (3):

$$\alpha=(V_k \cdot I_b)/(L \cdot v) \quad (1)$$

$$\beta=(V_k \cdot I_b)/(d \cdot v) \quad (2)$$

$$0.6-0.06\beta \leqq \alpha \leqq 0.90-0.08\beta \quad (3).$$

2. The method defined in claim 1 wherein the steel sheet has a composition of about:

C: 0.01–0.10% by weight
Si: 2.0–4.5% by weight
Mn: 0.02–0.12% by weight and inhibitors and incidental impurities, and the balance Fe.

3. A stacked transformer made of a grain oriented silicon steel sheet and having a noise difference (dBi−dB'i) less than 5 dB, said sheet capable of being produced by a method which comprises:

preparing a finish-annealed grain oriented silicon steel sheet;

irradiating the surface of said grain oriented silicon steel sheet with an electron beam directed along scan paths which cross the rolling direction of said steel sheet, said irradiating having been applied to said sheet at a scanning speed v(cm/s) and a spacing L(cm) in the rolling direction, with an electron beam having a beam diameter d(cm) generated by a current $I_b$ (mA) and an acceleration voltage $V_k$ (kV);

wherein said beam has been applied with a surface energy density $\alpha$ (J/cm$^2$) on the surface of said steel sheet as determined by the following formula (1), and is about 0.16 J/cm$^2$ or more, and wherein said surface energy density $\alpha$ (J/cm$^2$) and a surface energy density $\beta$ (J/cm$^2$) on the scan paths meet the approximate condition of the following formula (3):

$$\alpha=(V_k \cdot I_b)/(L \cdot v) \quad (1)$$

$$\beta=(V_k \cdot I_b)/(d \cdot v) \quad (2)$$

$$0.6-0.06\beta \leqq \alpha \leqq 0.90-0.08\beta \quad (3).$$

4. The slacked transformer defined in claim 3 wherein the steel sheet has a composition of about:

C: 0.01–0.10% by weight

Si: 2.0–4.5% by weight

Mn: 0.02–0.12% by weight and inhibitors and incidental impurities, and the balance Fe.

5. A stacked transformer having a noise difference (dBi−dB'i) less than 5 dB, said transformer comprising finish-annealed grain oriented silicon steel sheet having reduced iron loss, said sheet having been irradiated by an electron beam having a diameter d (cm) generated by a current $I_b$ (mA) and an acceleration voltage $V_k$ (kV), said beam having been applied to a surface of said sheet at a scanning speed v (cm/s) in scan paths spaced by distance L (cm) to provide a surface energy density $\alpha$ (J/cm$^2$) on said surface and a path energy density $\beta$ (J/cm$^2$) on each of said paths, said surface energy density $\alpha$ and path energy density $\beta$ satisfying formulas (1)–(3):

$$\alpha=(V_k \cdot I_b)/(L \cdot v) \quad (1)$$

$$\beta=(V_k \cdot I_b)/(d \cdot v) \quad (2)$$

$$0.6-0.06\beta \leqq \alpha \leqq 0.90-0.08\beta \quad (3).$$

6. The stacked transformer of claim 5 wherein said sheet comprises about 0.01–0.10 wt % of C, 2.0–4.5 wt % of Si, and 0.02–0.12 wt % of Mn.

7. A stacked transformer having a noise difference (dBi−dB'i) less than 5 dB, said transformer comprising finish-annealed grain oriented silicon steel sheet with reduced iron loss, said sheet being capable of being produced by a method comprising the steps of:

preparing said finish-annealed grain oriented silicon steel sheet; and irradiating the surface of said sheet with an electron beam directed along scan paths which cross the rolling direction of said steel sheet, said electron beam being applied to said sheet at a scanning speed v (cm/s) and a spacing L (cm) in the rolling direction, said electron beam being generated by a current $I_b$ (mA) and an acceleration voltage $V_k$ (kV) and having a beam diameter d (cm), wherein said beam is applied with a surface density $\alpha$ (J/cm$^2$) of at least about 0.16 J/cm$^2$ on the surface of said sheet and a surface density $\beta$ (J/cm$^2$) on said scan paths according to the following formulas:

$$\alpha=(V_k \cdot I_b)/(L \cdot v);$$

$$\beta=(V_k \cdot I_b)/(d \cdot v); \text{ and}$$

$$0.6-0.06\beta \leqq \alpha \leqq 0.90-0.08\beta.$$

8. The stacked transformer of claim 7, wherein said sheet has a composition comprising about 0.01–0.10 wt % of C, 2.0–4.5 wt % of Si, and 0.02–0.12 wt % of Mn.

* * * * *

UNITED STATES PATENT AND TRADEMARK OFFICE

CERTIFICATE OF CORRECTION

PATENT NO. : 5,411,604

DATED : May 2, 1995

INVENTOR(S) : Yukio Inokuti, Kazuhiro Suzuki and Eiji Hina

It is certified that error appears in the above-indentified patent and that said Letters Patent is hereby corrected as shown below:

In Column 3, line 49, please change "DRAWING" to --DRAWINGS--.

In Column 5, line 65, please change "≥" to --≤--.

In Column 7, line 48, please change "Ai" to --Al--.

In Column 13, line 3, please change "slacked" to --stacked--.

Signed and Sealed this

Eighteenth Day of July, 1995

*Attest:*

*Attesting Officer*

BRUCE LEHMAN

*Commissioner of Patents and Trademarks*